United States Patent [19]

Foster, Jr.

[11] 4,223,736

[45] Sep. 23, 1980

[54] METHOD FOR SHUTTING IN A PRODUCTION WELL

[75] Inventor: C. Mackay Foster, Jr., Denton, Tex.

[73] Assignee: Mobil Oil Corporation, New York, N.Y.

[21] Appl. No.: 13,712

[22] Filed: Feb. 21, 1979

[51] Int. Cl.[3] ..... E21B 34/06; E21B 43/12

[52] U.S. Cl. ..... 166/315; 166/321; 166/363

[58] Field of Search ..... 166/321-324, 166/53, 72, 314, 332, 363, 364, 362, 315

[56] References Cited

U.S. PATENT DOCUMENTS

| | | | |
|---|---|---|---|
| 3,016,955 | 1/1962 | Magill et al. | 166/321 |
| 3,035,641 | 5/1962 | Page | 166/321 X |
| 3,065,793 | 11/1962 | Page | 166/321 X |
| 3,860,066 | 1/1975 | Pearce et al. | 166/72 |
| 3,897,825 | 8/1975 | Tausch | 166/321 X |
| 4,086,935 | 5/1978 | Raulins et al. | 166/321 X |

*Primary Examiner*—Stephen J. Novosad
*Attorney, Agent, or Firm*—C. A. Huggett; Drude Faulconer

[57] ABSTRACT

A method and apparatus for automatically shutting in a producing well whenever the pressure in the well annulus drops below a defined pressure. A valve is positioned in the production tubing above an isolated production formation in the well and is maintained in an open position in response to the defined pressure in the well annulus. When the defined pressure is lost in the well annulus (e.g. due to intersection by a second well being drilled in the proximity of the producing well), the valve will close to shut in the producing well.

3 Claims, 1 Drawing Figure

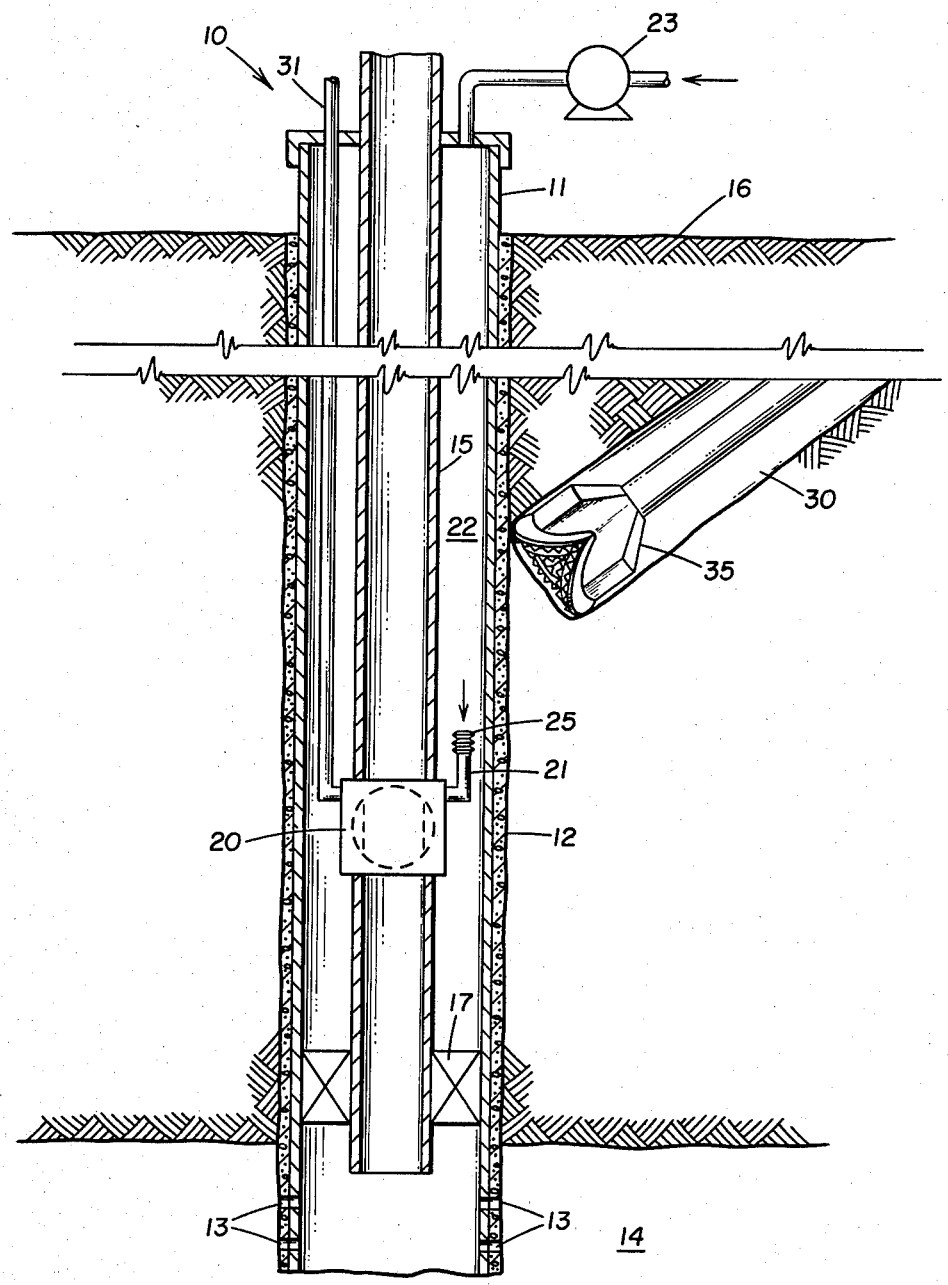
10
31
23
11
16
15
22
30
35
25
21
20
12
17
13
13
14

METHOD FOR SHUTTING IN A PRODUCTION WELL

BACKGROUND OF THE INVENTION

The present invention relates to a method and apparatus for automatically shutting in a producing well whenever the pressure in the well annulus is lost and more particularly relates to a method and apparatus for shutting in a producing well whenever the casing in the well is ruptured or accidentally penetrated by a second well being drilled in the proximity of the producing well.

In developing certain oil fields, directional drilling techniques are used to drill several wells from a relatively centralized surface location. Where the wells are significantly spaced at the surface, intersection of two wells occurs only rarely. However, where the wells are drilled in "clusters", e.g. at many offshore locations and at some landbased locations, intersection of one or more wells during drilling is a stark reality. In cluster drilling, anywhere from twelve to twenty wells may be started within a surface spacing of from five to eight feet of one from another. Each well is designed to be drilled vertically downward to a desired depth before it is "kicked off" into a deviated path toward its final destination. It can easily be seen that if a well varies slightly during the initial vertical drilling stage, there is a real probability that it will penetrate the vertical portion of a closely spaced, adjacent well.

Traditionally, all wells in a cluster were first drilled before any of the wells were put on production. However, recently due to technical developments, e.g. larger offshore platforms and the increased demand for petroleum, some wells in a cluster may now be drilled, completed, and put on production before all of the wells in the cluster are drilled. If the wellbore of a well being drilled intersects a live producing well, there is a real danger that the well being drilled may "blow out" and/or a fire or other hazardous condition may occur at either the producing well and/or the well being drilled. Therefore, the need is obvious for quickly and safely shutting in a producing well, if and when the producing wellbore is accidentally penetrated by a well being drilled.

SUMMARY OF THE INVENTION

The present invention provides a method and apparatus for shutting in a producing well in response to loss of a defined pressure in the annulus of the well above an isolated production formation.

Specifically, a producing well is completed and cased and a production tubing is placed in the well to provide fluid communication between a production formation and the surface. A packer is set at a point above the production formation to isolate the well annulus above the packer from the production formation. A valve is positioned in the tubing at a point above the packer to control flow through the tubing. The valve is preferably of the type commonly referred to as a hydraulically operated, surface controlled, subsurface, tubing mounted ball type, safety valve which is normally held open by a pressure supplied to the valve inlet through a control line extending to the surface. If the pressure in the control line is lost, preloaded springs in the valve move the valve to a closed position to block flow through the tubing.

In the present invention, there is no control line attached to the inlet of the valve but instead the inlet of the valve is in direct communication with the well annulus above the packer. The well annulus above the packer is preferably filled with a noncompressible fluid, e.g. salt water, or diesel oil and pressure is applied thereto to establish a defined pressure in the well annulus which will maintain the valve in an open position. This defined pressure is preferably substantially in excess of the mud column pressure of any well being drilled in the proximity of the producing well.

The valve is positioned in the tubing at a depth below the recognized danger zone in which intersection by a well being drilled in the proximity is most likely to occur. If the casing in the producing well is penetrated by the drill in the second well, the defined pressure in the production well annulus will quickly be lost into the second well and the valve in the tubing will close almost immediately to shut in the production well. Also, if the defined pressure in the annulus is lost for any reason, the valve will close to shut in the production well.

BRIEF DESCRIPTION OF THE DRAWING

The actual operation and the apparent advantages of the invention will be better understood by referring to the drawing in which:

The FIGURE is a cross-sectional view of a production well incorporating the present invention.

DESCRIPTION OF THE PREFERRED EMBODIMENTS

Referring more particularly to the drawings, the figure depicts production well 10 which is completed in a standard and well known manner. Casing 11 is secured throughout the wellbore of well 10 by means of cement 12 and has perforations 13 therein adjacent producing formation 14. Production tubing 15 is positioned within casing 11 and extends from the surface 16 to a point adjacent formation 14. Packer 17 is set within casing 11 around tubing 15 at a point above formation 14 to isolate the production interval within well 10 as is well known in the art.

In accordance with the present invention, safety valve 20 is positioned in tubing 15 at a point above packer 17. The precise details of valve 20 form no part of the present invention but valve 20 is preferably of the type commercially available and commonly known as hydraulically operated, subsurface, tubing mounted, ball type valves, e.g. the safety valves disclosed on pages 730–734 and 5328–5329 of the COMPOSITE CATALOG OF OIL FIELD EQUIPMENT AND SERVICES, 33rd Revision, 1978–1979, published by WORLD OIL, Houston, Texas. This type of safety valve requires a control line which is attached to an inlet on the valve and which extends to the surface through which hydraulic fluid is applied to the valve to hold it in an open position. When the pressure on the hydraulic fluid in surface controlled, control line is released for any reason, preloaded springs in the valve move it to a closed position to shut off flow through the tubing.

However, in the present invention, there is no control line attached to inlet 21 of valve 20 but instead inlet 21 is exposed to annulus 22 formed between casing 11 and tubing 15. Annulus 22 is filled with a noncompressible fluid, e.g. salt water or diesel oil and is maintained under pressure by means of pump 23 or the like. The fluid in annulus 22 acts through inlet 21 to hold valve 20 in an open position whenever annulus 22 is under a defined pressure. In many instances where there is a possibility of the fluid in annulus 22 plugging or otherwise damaging the operation of valve 20, valve 20 can be filled with hydraulic fluid and a bellows 25 or a piston unit (not shown) is attached to inlet 21 to physically separate the hydraulic fluid from the fluid in annulus 22.

In operation, well 10 is cased and production tubing 15 including valve 20 is run into place. Valve 20 will be positioned at a depth below the recognized danger zone in which intersection by directionally drilled well 30 is most likely to occur. In most known instances, this danger zone will lie above 2,500 feet which is within the operating range of commercially available, spring-closing safety valves. Where the danger zone extends below 2,500 feet, it may be necessary to use a commercially available dual control line safety valve (e.g. see pages 733 and 5328 of the COMPOSITE CATALOG, cited above) wherein the high pressure side, i.e. inlet 21 is open to annulus 22 while a balance line 31 extends to the surface. As understood in the art, the dual control feature provides balanced hydraulic pressures across valve 20 in deep wells to ensure that there will be minimum hydrostatic head to overcome during closing of valve 20.

Annulus 22 is filled with a noncompressible fluid, e.g. salt water or diesel oil, and is pressured up so that the annulus fluid acts through inlet 21 to move valve 20 to an open position. The final annulus pressure at the valve will be substantially in excess, e.g. 500 psi, of the expected mud column pressure in any potentially intersecting well 30 being drilled in the proximity of producing well 11 for a reason explained below. Also, the final annulus pressure will be slightly above the actual pressure required for opening and closing valve 20 so that pressure-sensitive controlled pump 23 can routinely compensate for any small losses in annulus pressure due to normal leak off and volume changes of the annulus fluid due to temperature or the like.

With valve 20 being held in an open position by the pressure in annulus 22 which is substantially in excess of the expected mud column pressure in well 30, it can easily be seen that if drill bit 35 in well 30 penetrates casing 11 of well 10, annulus pressure in well 10 will quickly be lost into well 30, having a substantially lower pressure, and valve 20 will close almost immediately. The closing of valve 20 isolates producing formation 14 in well 10 and eliminates the danger of a blowout of well 30 and/or some other dangerous condition.

Although an intersecting well 30 has been illustrated as the actuating mechanism for shutting in well 10, it should also be recognized that any sudden loss of annulus pressure, e.g. rupture of casing 11 due to earthquake or the like, would also act to close valve 20. Further, surface control of valve 20 is maintained since valve 20 can be quickly closed by merely venting annulus pressure at the surface.

What is claimed is:

1. A method for shutting in a producing well in response to a loss of a defined annulus pressure in the wellbore of said producing well, said method comprising:

positioning a production tubing in said well to fluidly communicate a producing formation in said producing well to the surface;

isolating the annulus between said wellbore and said production tubing above the production formation from said formation;

placing a valve in said production tubing to control flow therethrough at a point above said isolated production formation, said valve adapted to remain in an open position when the pressure in said annulus above said isolated production formation exceeds said defined value and adapted to close when the pressure in said annulus decreases below said defined value;

filling said annulus above said isolated production formation with a noncompressible fluid; and applying said defined pressure to said fluid wherein said defined pressure is substantially greater than the mud column pressure of a second well being drilled in the proximity of said producing well.

2. The method of claim 1 wherein said fluid comprises: salt water.

3. The method of claim 1 wherein said fluid comprises: diesel oil.

* * * * *